United States Patent [19]

Sarnes et al.

[11] Patent Number: 4,495,148

[45] Date of Patent: Jan. 22, 1985

[54] PROCESS AND APPARATUS FOR REMOVING COMBUSTIBLE LUBRICANTS FROM SINTERABLE WORKPIECES

[76] Inventors: Reiner Sarnes, Gerhart Hauptnannstr. 16, D-7302 Ostfildern 2; Emil Heinrich, Bruckner Str. 1, D-7054 Korb, both of Fed. Rep. of Germany

[21] Appl. No.: 457,145

[22] Filed: Jan. 11, 1983

[30] Foreign Application Priority Data

Jan. 12, 1982 [DE] Fed. Rep. of Germany ..... 3200582

[51] Int. Cl.[3] ..... B22F 3/00

[52] U.S. Cl. ..... 419/57; 419/31

[58] Field of Search ..... 419/30, 31, 56, 57, 419/36, 32, 33, 34; 75/238; 134/19; 110/236; 266/108

[56] References Cited

U.S. PATENT DOCUMENTS

| | | | |
|---|---|---|---|
| 3,230,596 | 1/1966 | Batigne et al. | 266/108 |
| 3,326,676 | 6/1967 | Rübel et al. | 419/31 |
| 3,346,417 | 10/1967 | Ehrlich | 134/19 |
| 3,971,632 | 7/1976 | Menrad et al. | 75/238 |
| 4,104,061 | 8/1978 | Roberts | 419/31 |
| 4,396,434 | 8/1983 | Forster | 134/19 |

*Primary Examiner*—Benjamin R. Padgett
*Assistant Examiner*—T. J. Wallen
*Attorney, Agent, or Firm*—Karl F. Ross; Herbert Dubno

[57] ABSTRACT

Workpieces pressed from metallic particles, impregnated with an organic lubricant, are sintered in a muffle furnace after traversing a preheating chamber serving for the removal of the lubricant. A substantially oxygen-free protective gas, consisting at least in part of combustible constituents, is passed in counterflow to the workpieces through the preheating chamber in which it is mixed with a hot oxygen-rich gas, preferably air, admitted into the chamber at locations spaced apart in the transport direction of the workpieces to burn the combustible components of the protective gas along with the evaporating lubricant; the oxygen content decreases progressively from a relatively high value near the entrance end of the preheating chamber, where the workpieces are protected from oxidation by their low initial temperature, toward the exit end. The entering air may be brought to a high temperature by heat exchange with the hot gas mixture leaving the chamber at its entrance end.

14 Claims, 5 Drawing Figures

PROCESS AND APPARATUS FOR REMOVING COMBUSTIBLE LUBRICANTS FROM SINTERABLE WORKPIECES

FIELD OF THE INVENTION

Our present invention relates to a process for the removal of combustible lubricants from sinterable workpieces, consisting essentially of pressed metallic particles, as well as to an apparatus for carrying out the process.

BACKGROUND OF THE INVENTION

Workpieces of the type referred to are generally sintered in an oven under a protective atmosphere preventing their oxidation, specifically a substantially oxygen-free gas which usually contains combustible constituents such as carbon monoxide. When the particles are permeated by a lubricant, e.g. an organic substance such as zinc stearate or a wax, the sintering oven may comprise a muffle furnace in cascade with a preheating chamber which the workpieces must traverse before sintering and wherein the lubricant is volatilized. The protective gas, passing in counterflow to the advancing workpieces through the preheating chamber, is designed to sweep out the vaporized lubricant and to prevent its recondensation on the oncoming workpieces entering the chamber in a relatively cold state, normally at room temperature. It is difficult, however, to control the chamber temperature precisely enough to avoid a thermal decomposition of the lubricant with resulting precipitation of elemental carbon on the workpieces. The carbon in that case would form a hard coating so as to seal the interstices of the particulate bodies and prevent the evaporation of remaining lubricant whose gas pressure could then destroy the workpieces.

Attemps have been made to deal with this problem by a very slow heating of the workpieces. This, of course, has the drawback of requiring rather lengthy preheating chambers and extended treatment periods.

Another known solution involves the admission of an additional flow of hot low-oxygen gas into the preheating chamber. This flow is generated by the combustion of gaseous hydrocarbons (e.g. natural gas) with limited air supply in a burner attached to the exit end of the preheating chamber. The resulting increase in the quantity of protective gas and of its flow rate in that chamber reduces the transit and heating time of the workpieces, in comparison with the aforedescribed procedure, but has the drawback of practically doubling the amount of combustible components at the chamber entrance. These partly poisonous components burn upon leaving the chamber and mixing with the ambient air. This leads to an undesirable rise in the temperature around the sintering oven and is inconvenient for the operating personnel. A further disadvantage is the energy loss involved in the preheating of the additional gas mass and the expense of installing and operating the burner.

OBJECTS OF THE INVENTION

An important object of our present invention, therefore, is to provide a process for freeing metallic workpieces about to be sintered from combustible lubricants with avoidance of the drawbacks referred to.

A related object is to provide simple means in an otherwise conventional sintering oven for implementing our improved process.

SUMMARY OF THE INVENTION

Our invention is applicable to a sintering oven of the aforedescribed structure, comprising a preheating chamber in cascade with a muffle furnace, in which the heating gas of low (preferably near-zero) oxygen content is blown through the preheating chamber in counterflow to the advancing workpieces and also traverses the muffle furnace and an extension thereof designed to let the sintered workpieces cool down to a temperature low enough to prevent their oxidation upon contact with air. Pursuant to this invention, an oxygen-rich gas is heated to an elevated temperature sufficient to volatilize the lubricant permeating the workpieces which enter the preheating chamber at a substantially lower (e.g. room) temperature. This hot oxygen-rich gas, which is preferably air, is admitted to the preheating chamber at locations spaced along the path of the workpieces for admixture with the low-oxygen protective gas so as to ignite the combustible constituents of the latter along with the evaporating lubricant whereby the oxygen content of the gas mixture is progressively depleted on the way from the entrance end to the exit end of the chamber so as to prevent oxidation of the workpieces traversing same.

We prefer to preheat the oxygen-rich gas—referred to hereinafter as air—to a level of at least 500° C. which is sufficient for a complete vaporization of the usual organic lubricants. Metals or alloys sinterable at about 1,000° C. are generally not readily oxidizable at temperatures below 400° C. so that the cold workpieces can safely enter the preheating chamber at the end where the oxygen content of the gas mixture is high. At the opposite end of the chamber, where the workpieces are hot, the oxygen concentration is low; in fact, much of the oxygen admitted near that exit end is consumed by the combustion of lubricant and of part of the protective gas. The hot waste gases leaving the chamber at its entrance end will not ignite since they no longer contain a significant proportion of combustible components.

The burning of gas and lubricant inside the preheating chamber reduces or even eliminates the need for supplying external heat to that chamber in order to maintain it at the desired temperature. In fact, according to another advantageous feature of our invention, the waste heat of the exiting gas mixture can be utilized to preheat the air about to be admitted into the chamber.

Thus, an apparatus embodying our invention basically comprises an upstream preheating chamber and a downstream muffle furnace provided with respective first and second heating means and with conveyor means carrying the workpieces to be sintered, an at least partly combustible protective gas of low oxygen content being driven by blower means through the preheating chamber in counterflow to the oncoming workpieces while passing also through the muffle furnace, all as discussed above and known per se. Pursuant to our present improvement, however, a source of hot oxygen-rich gas (air) forming part of the second heating means opens into the preheating chamber at locations spaced along the path of the workpieces for admixture with the protective gas whose combustible constituents are thereby ignited along with the lubricant evaporated from the workpieces impregnated therewith.

Advantageously, the source of hot air includes a conduit traversing a zone near the entrance end of the preheating chamber where the air is in heat-exchanging relationship with a hot gas flow leaving that chamber.

By this means the air in the conduit may be heated to a temperature well above the level of about 500° C. needed for the vaporization of the lubricant.

BRIEF DESCRIPTION OF THE DRAWING

The above and other features of our invention will now be described in detail with reference to the accompanying drawing in which.

SPECIFIC DESCRIPTION

Figure 1:
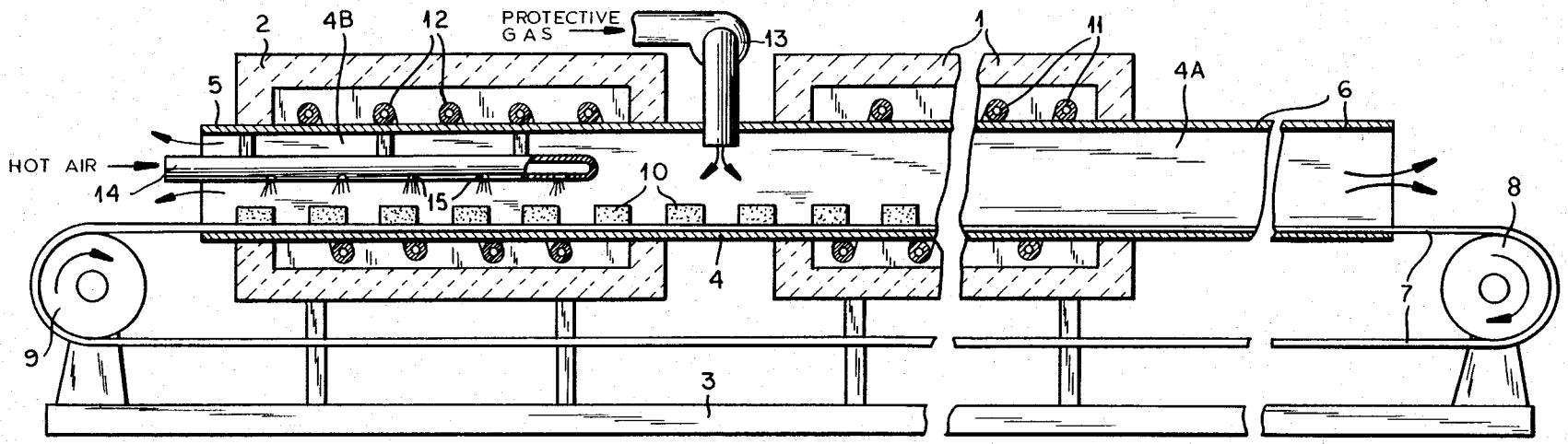
FIG. 1 is a sectional elevational view of an apparatus embodying our invention.

In FIG. 1 we have shown a downstream section 1 and an upstream section 2 of a sintering oven supported on a base 3, the two sections being traversed by a horizontal prismatic duct 4 in which workpieces 10 to be sintered are advanced on the upper run of an endless conveyor belt 7 moving from left to right. The belt 7 is wound around a downstream roller 8 and an upstream roller 9, at least one of which is driven by a nonillustrated motor, whereby the workpieces 10 are continuously transported through a preheating chamber 4B and a muffle furnace 4A in cascade with each other. The preheating chamber 4B is formed by an upstream portion of duct 4, surrounded by oven section 2, while the muffle furnace 4A is formed by a downstream portion of that duct surrounded by oven section 1. Heating coils 11 and 12 in sections 1 and 2 surround the two duct portions to maintain their interior at suitable temperatures, e.g. between 1,000° and 1,200° C. in the case of the furnace 4A and between 500° and 600° C. in the case of the chamber 4B. The workpieces 10 are blocks of metallic particles impregnated with an organic lubricant, as discussed above. A rear end 5 of duct 4 projects from oven section 2 while a forward extension 6 thereof serves as a cooling zone in which the temperature of the workpieces is brought down to a suitably low level.

A protective gas of low or zero oxygen content, e.g. natural gas, is driven by a blower 13 into the duct 4 midway between the portions constituting the preheating chamber 4B and the muffle furnace 4A. Part of that gas flows forward through the furnace and the adjoining cooling zone 6 while another part moves in counterflow to the workpieces 10 through the preheating chamber towards its entrance end 5.

In accordance with our present invention, hot air is admitted into the preheating chamber 4B through a conduit 14 provided with a number of orifices 15 that are spaced apart in the direction of workpiece motion. The air entering the chamber 4B at a point farthest to the right, i.e. near the closed end of conduit 14, quickly mingles with the protective gas and with the vapors of lubricant rising from the workpieces to ignite the combustible substances.

As a result, these substances burn within chamber 4B and the gas mixture leaving the duct 4 at its end 5 is virtually free from poisonous CO. While the mixture is rich in oxygen near the entrance end 5, the workpieces coming in at a temperature of, say, 20° C. are in no danger of oxidation.

Figure 2:
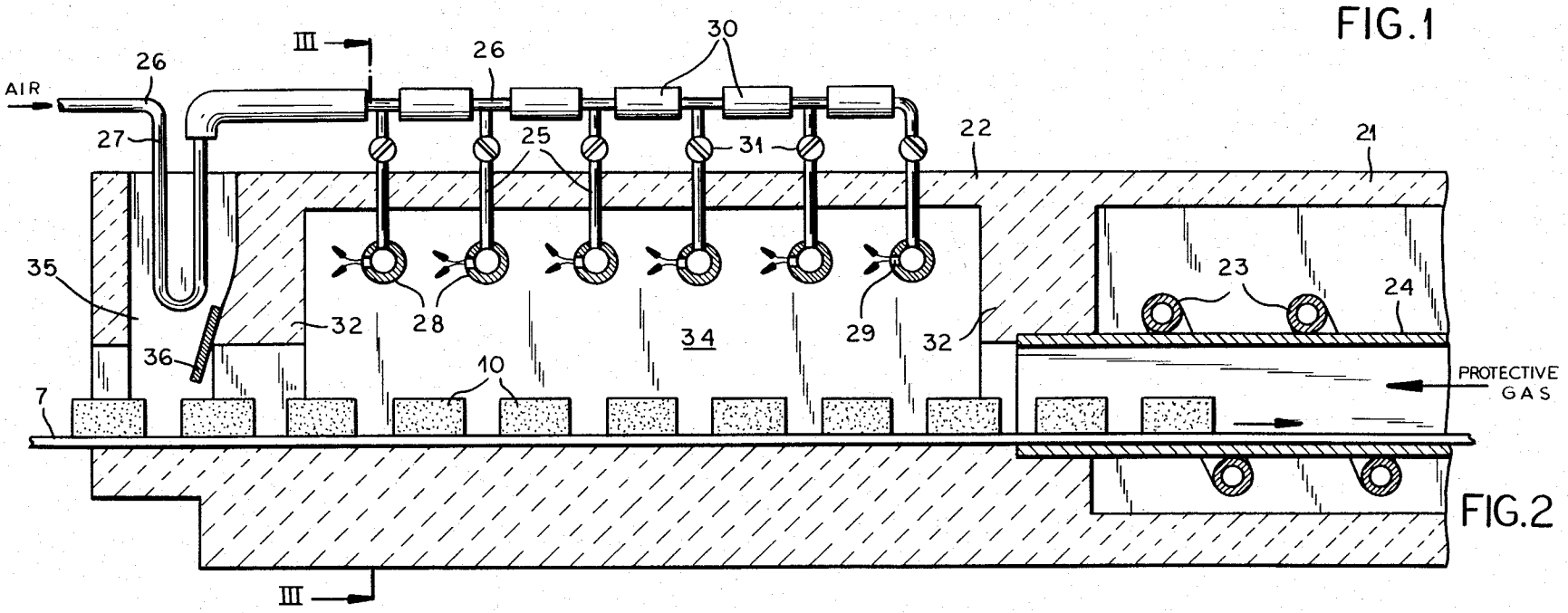
FIG. 2 is a view similar to FIG. 1, illustrating another embodiment.
Figure 3:
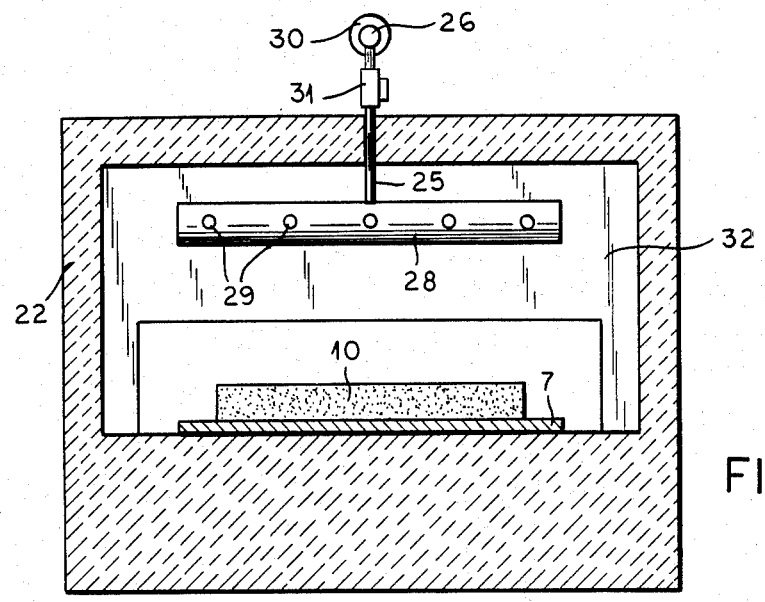
FIG. 3 is a cross-sectional view taken on the line III—III of FIG. 2.

In the embodiment of FIGS. 2 and 3, the muffle furnace is again represented by part of a prismatic duct 24 surrounded by a heating coil 23 within an oven section 21. That section is separated by a partition 32 from an adjoining upstream section forming a preheating chamber 34. As in the preceding embodiment, workpieces 10 pass on a conveyor belt 7 from left to right (FIG. 2) through the chamber 34 and the furnace formed by duct 24 which in this instance starts beyond the chamber; its downstream extension, forming a cooling zone, has not been illustrated. The front end of chamber 34 is constituted by a wall 32 of the refractory oven section 22 which is formed with a gap 35 serving as a heat-exchanging zone between the waste gases leaving the chamber 34 and a loop 27 of a conduit 26 carrying air into that chamber. A baffle 36 throttles the gas flow escaping from that chamber.

Beyond its loop 27, conduit 26 is surrounded by thermal insulation 30 except at certain locations where it is joined to branches 25 extending into chamber 34. There as best seen in FIG. 3, each branch 25 ends in a transverse tube 28 with discharge orifices 29 spaced apart in a direction perpendicular to the transport path in order to maintain a substantially uniform atmosphere throughout the width of that chamber. This arrangement is advantageous in the case of a broad conveyor, as here shown. With ignition taking place above the entire width of belt 7, there are no low-temperature areas on which vapors could condense. Each branch 25, furthermore, includes a manually settable control valve 31 for enabling suitable adjustment of the oxygen supply reaching different regions of chamber 34.

It will be noted that, in this embodiment, the upstream chamber 34 does not have a counterpart of the heating means 12 of FIG. 1 but its temperature is maintained at the desired level exclusively by the air preheated in zone 35 and by the combustion taking place in its interior. The heat exchange occurring in that zone 35 advantageously raises the temperature of the conveyed air to about 700° C. Protective gas, containing little or no oxygen, is introduced into the duct 24 at its downstream end and passes into the chamber 34 in counterflow to the movement of the workpieces 10.

Figure 4:
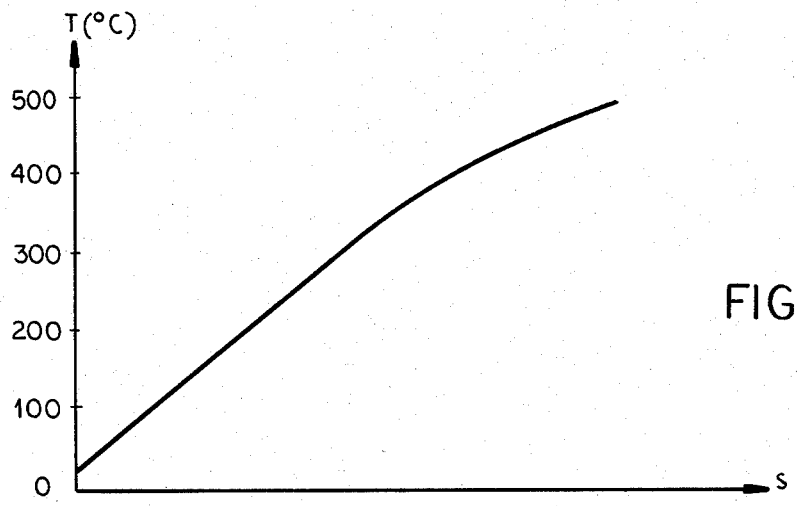
FIG. 4 is a graph showing the change in temperature of oncoming workpieces in a preheating chamber of the apparatus of FIG. 1 or 2.
Figure 5:
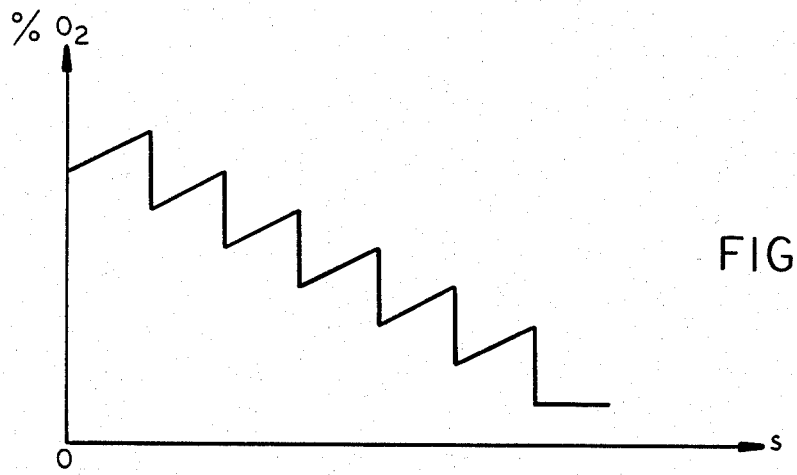
FIG. 5 is a graph qualitatively representing the air concentration in that preheating chamber.

The gradual heating of the workpieces from an entrance temperature of about 20° C. to an exit temperature of about 500° C. has been diagrammed in the graph of FIG. 4. FIG. 5 shows, in a general manner, the variations in the percentage of oxygen within the gaseous atmosphere of chamber 34 which increases at each discharge tube 24 and, with the incoming air swept by the protective gas toward the entrance end of the chamber, drops somewhat on account of the combustion taking place in the regions between adjoining tubes.

We claim:

1. A process for removing a combustible lubricant from workpieces of pressed metallic particles advancing through a preheating chamber into a muffle furnace for sintering, comprising the steps of:

(a) blowing an at least partly combustible protective gas of low oxygen content through said preheating chamber in counterflow to the advancing workpieces, said protective gas also traversing said muffle furnace to envelop the workpieces being sintered;

(b) heating an oxygen-rich gas to an elevated temperature sufficient to volatilize the lubricant permeating the workpieces which enter the preheating chamber at a substantially lower temperature; and (c) admitting the hot oxygen-rich gas to said preheating chamber at locations spaced along the path of the workpieces for admixture with said protective gas and resulting ignition of combustible constituents of the latter and of the evaporating lubricant whereby the oxygen content of the mixture is progressively depleted on the way from the entrance end to the exit end of the preheating chamber to an extent preventing oxidation of the workpieces heated up along said path.

2. A process as defined in claim 1 wherein said oxygen-rich gas is air.

3. A process as defined in claim 1 wherein the heating of the oxygen-rich gas in step (b) takes place through heat exchange with the hot gas mixture leaving the preheating chamber at the entrance end thereof.

4. A process as defined in claim 1 wherein the oxygen-rich gas is heated in step (b) to a temperature of at least 500° C.

5. A process as defined in claim 1 wherein the protective gas is blown into the preheating chamber by way of the adjoining muffle furnace.

6. A process as defined in claim 1 wherein the protective gas is blown into the preheating chamber at a junction thereof with the muffle furnace whereby part of the protective gas is diverted into said muffle furnace for codirectional flow with the workpieces being sintered.

7. An apparatus for sintering workpieces of pressed metallic particles initially impregnated with a combustible lubricant, comprising:

a muffle furnace having first heating means for maintaining same at a sintering temperature;

a preheating chamber adjoining said muffle furnace;

conveyor means traversing said preheating chamber and said muffle furnace for continuously advancing oncoming workpieces, entering said preheating chamber substantially at room temperature, through the latter into and through said muffle furnace for sintering;

blower means for driving an at least partly combustible protective gas of low oxygen content through said preheating chamber in counterflow to the oncoming workpieces advancing on said conveyor means, said protective gas also traversing said muffle furnace to envelop the workpieces being sintered;

a source of hot oxygen-rich gas opening into said preheating chamber at locations spaced along the path of said workpieces for admixture with said protective gas and resulting ignition of combustible constituents of the latter and of lubricant evaporating from said workpieces; and second heating means including said source for maintaining said preheating chamber at an elevated temperature.

8. An apparatus as defined in claim 7 wherein said second heating means includes a zone near the entrance end of said preheating chamber traversed by a conduit carrying said oxygen-rich gas in heat-exchanging relationship with a hot gas flow leaving said preheating chamber.

9. An apparatus as defined in claim 7 wherein said source includes conduit means in said preheating chamber provided with orifices for the emission of said oxygen-rich gas.

10. An apparatus as defined in claim 9 wherein said conduit means comprises a tube terminating in a plurality of branches extending at said locations across the path of said workpieces, each of said branches being provided with a plurality of said orifices separated in a direction transverse to said path.

11. An apparatus as defined in claim 9, further comprising flow-control means for varying the rate of emission of said oxygen-rich gas at said orifices.

12. An apparatus as defined in claim 7 wherein said muffle furnace is a duct with a forward extension forming a cooling zone.

13. An apparatus as defined in claim 12 wherein said duct has a rearward extension forming said preheating chamber.

14. An apparatus as defined in claim 12 wherein said duct starts at an end wall of said preheating chamber remote from the entrance end thereof.

* * * * *